US007912709B2

(12) United States Patent
Kim

(10) Patent No.: US 7,912,709 B2
(45) Date of Patent: Mar. 22, 2011

(54) METHOD AND APPARATUS FOR ESTIMATING HARMONIC INFORMATION, SPECTRAL ENVELOPE INFORMATION, AND DEGREE OF VOICING OF SPEECH SIGNAL

(75) Inventor: Hyun-Soo Kim, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 850 days.

(21) Appl. No.: 11/732,650

(22) Filed: Apr. 4, 2007

(65) Prior Publication Data

US 2007/0288232 A1 Dec. 13, 2007

(30) Foreign Application Priority Data

Apr. 4, 2006 (KR) ..... 10-2006-0030748

(51) Int. Cl.
*G10L 11/04* (2006.01)

(52) U.S. Cl. ..... 704/207; 704/205; 704/206; 704/209

(58) Field of Classification Search ..... 704/200, 704/201, 203, 205, 206, 207, 208, 209, 210, 704/214

See application file for complete search history.

(56) References Cited

U.S. PATENT DOCUMENTS

| | | | | |
|---|---|---|---|---|
| 5,189,701 | A * | 2/1993 | Jain | 704/207 |
| 5,701,390 | A | 12/1997 | Griffin et al. | |
| 2004/0133424 | A1 | 7/2004 | Ealey et al. | |

FOREIGN PATENT DOCUMENTS

| | | |
|---|---|---|
| JP | 2001177416 | 6/2001 |
| JP | 2006010906 | 1/2006 |
| KR | 1020020022256 | 3/2002 |
| KR | 10-0388388 | 6/2003 |
| KR | 1020030085354 | 11/2003 |
| KR | 1020040026634 | 3/2004 |

* cited by examiner

*Primary Examiner* — Huyen X. Vo

(74) *Attorney, Agent, or Firm* — The Farrell Law Firm, P.C.

(57) ABSTRACT

A degree of voicing is extracted using the characteristic of harmonic peaks existing in a constant period by converting an input speech or audio signal to a speech signal of the frequency domain, selecting the greatest peak in a first pitch period of the converted speech signal as a harmonic peak, thereafter selecting a peak having the greatest spectral value among peaks existing in each peak search range of the speech signal as a harmonic peak, extracting harmonic spectral envelope information by performing interpolation of the selected harmonic peaks, extracting non-harmonic spectral envelope information by performing interpolation of the non-harmonic peaks, and comparing the two pieces of envelope information to each other.

15 Claims, 7 Drawing Sheets

METHOD AND APPARATUS FOR ESTIMATING HARMONIC INFORMATION, SPECTRAL ENVELOPE INFORMATION, AND DEGREE OF VOICING OF SPEECH SIGNAL

PRIORITY

This application claims priority under 35 U.S.C. §119 to an application filed in the Korean Intellectual Property Office on Apr. 4, 2006 and assigned Serial No. 2006-30748, the contents of which are incorporated herein by reference.

BACKGROUND OF THE INVENTION

1. Field of the Invention

The present invention relates generally to speech signal processing, and in particular, to a method and apparatus for detecting peaks from a speech signal, and detecting harmonic information, spectral envelope information, and voicing rate information (a degree of voicing) using the detected peaks.

2. Description of the Related Art

All systems using a speech signal use spectral estimation information when processing the speech signal in a frequency domain. However, since the entire spectrum of a speech signal cannot be coded or transmitted because of various reasons, spectral envelope information that is the general information of major harmonic elements in the spectrum is coded and transmitted, and the transmitted spectral envelope information is analyzed by a decoder and used. Thus, it is very important to extract harmonic information from a speech signal, and the extracted harmonic information significantly affects all speech systems. The spectral estimation information is very important information to process a speech signal, and in particular, sound quality of a synthesized speech signal in speech coding significantly depends on the performance of spectral coding in which a spectral envelope is estimated and encoded. Voiced and unvoiced information is also requisite and important information in speech signal analysis.

Linear prediction analysis methods are most widely used for harmonic component analysis and spectral estimation of a speech signal and have a characteristic of reducing the amount of computation by representing the properties of the speech signal with only parameters. Linear prediction analysis methods used for speech analysis, synthesis, and compression can represent a waveform and a spectrum of a speech signal using a small number of parameters and extract the parameters with only simple calculation. Linear prediction analysis methods are based on the principle that a current sample is assumed using a linear set of pre-samples in the past and thus a current value can be estimated from sample values in the past.

The performance of linear prediction analysis methods depends on an order of linear prediction. However, only with an increase of the order, the amount of computation increases, and an increase of the performance is limited. In particular, a disadvantage of linear prediction analysis methods is based on the assumption that a signal is stable for a predetermined short time. That is, since linear predictive coding is performed based on the assumption that a vocal tract transfer function can be modeled using a linear all-pole model, linear prediction analysis methods cannot follow a signal abruptly fluctuating in a transition area of a speech signal. In particular, linear prediction analysis methods have a tendency showing inferior performance to a woman or child speaker.

In addition, linear prediction analysis methods have a problem when data windowing is used. Selecting data windowing always results in an exchange relationship between resolution of a time axis and resolution on a frequency axis. For example, for very high pitch speech, linear prediction analysis methods (representatively, an autocorrelation method and a covariance method) have a problem of following individual harmonics rather than a spectral envelope because of a long distance between harmonics.

SUMMARY OF THE INVENTION

The present invention addresses at least the above problems and/or disadvantages and provides at least the advantages described below. Accordingly, an aspect of the present invention is to provide a method and apparatus for simply, correctly estimating harmonic information, spectral envelope information, and a degree of voicing of a speech signal by analyzing a structure of the speech signal without estimation predicted by calculation with no assumption on the speech signal in order to overcome the limitation and assumptions of generally used spectral estimation methods.

Another aspect of the present invention is to provide a method and apparatus for estimating speech-signal peaks very robust to noise and estimating spectral envelope information and a degree of voicing of a speech signal, by using information on harmonic peaks always greater than noise.

A further aspect of the present invention is to provide a method and apparatus for estimating speech-signal peaks and speech signal spectral envelope information to detect a degree of voicing using a ratio of a harmonic spectral envelope detected by extracting harmonic peaks to a non-harmonic spectral envelope formed with peaks remaining by excluding the extracted harmonic peaks.

According to one aspect of the present invention, there is provided a method of estimating harmonic information and spectral envelope information of a speech signal, the method including converting a received speech signal of a time domain to a speech signal of a frequency domain; calculating a coarse pitch value of the speech signal and determining a peak search range using the coarse pitch value; setting a plurality of peak search ranges in the speech signal, detecting peaks existing in each of the peak search ranges, determining a peak having the greatest spectral value among the detected peaks as a harmonic peak in each of the peak search ranges, and outputting the harmonic peak of each of the peak search ranges as harmonic information of the speech signal; generating a harmonic spectral envelope by performing interpolation of the harmonic peaks, and outputting the generated harmonic spectral envelope as spectral envelope information of the speech signal.

The method may further include generating and outputting a non-harmonic spectral envelope by performing interpolation of peaks excluding the harmonic peak from among the peaks detected in each of the peak search ranges; and detecting a degree of voicing indicating a rate of a voiced sound included in the speech signal by comparing energy of the harmonic spectral envelope to energy of the non-harmonic spectral envelope.

BRIEF DESCRIPTION OF THE DRAWINGS

The above and other objects, features and advantages of the present invention will become more apparent from the following detailed description when taken in conjunction with the accompanying drawing in which.

DETAILED DESCRIPTION OF THE PREFERRED EMBODIMENTS

Figure 1:
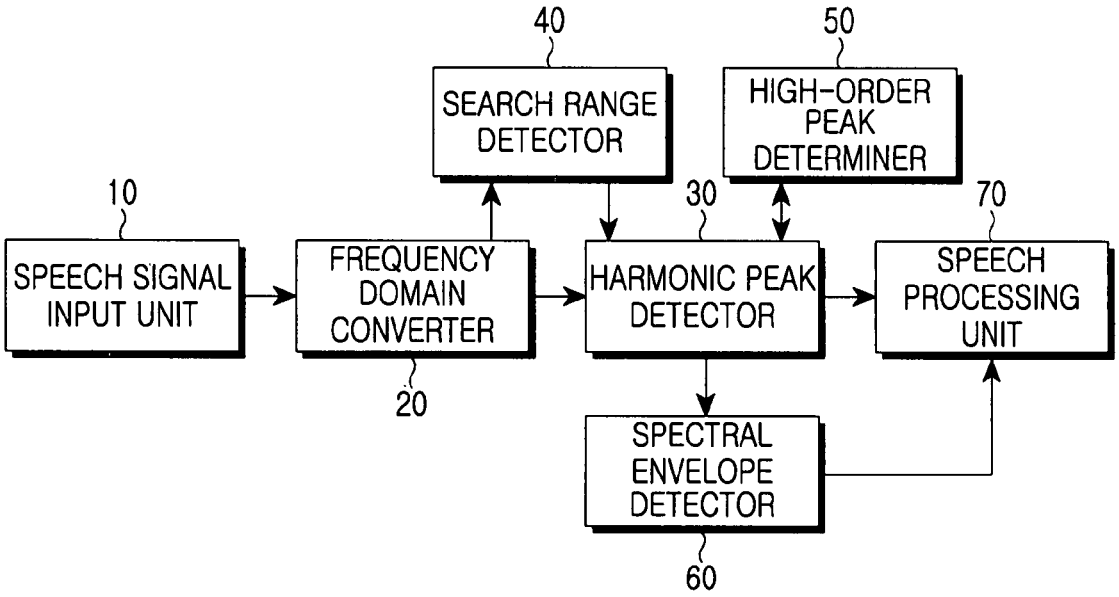
FIG. 1 is a block diagram of an apparatus for estimating harmonic information and spectral envelope information of a speech signal according to the present invention.

Preferred embodiments of the present invention will be described herein below with reference to the accompanying drawings. In the drawings, the same or similar elements are denoted by the same reference numerals even though they are depicted in different drawings. In the following description, well-known functions or constructions are not described in detail since they would obscure the invention in unnecessary detail.

The present invention, by using a characteristic that harmonic peaks existing at a constant period, converts a received speech or audio signal of a time domain to a speech signal of a frequency domain, selects the greatest peak in a first pitch period of the converted speech signal of the frequency domain as a first harmonic peak, selects a peak having the greatest spectral value among peaks existing in each of peak search ranges of the speech signal as a harmonic peak, and extracting envelope information by performing interpolation of the selected harmonic peaks. The peak search range is determined using Coarse Pitch (CP) information. A confidence interval of True Pitch (TP) information is considered.

FIG. 1 shows an apparatus for estimating harmonic information and spectral envelope information of a speech signal according to the present invention. The apparatus includes a speech signal input unit 10, a frequency domain converter 20, a harmonic peak detector 30, a search range determiner 40, a high-order peak determiner 50, a spectral envelope detector 60, and a speech processing unit 70.

The speech signal input unit 10 can include a microphone or a similar device, and receives a speech signal and outputs the received speech signal to the frequency domain converter 20. The frequency domain converter 20 converts the input speech signal of a time domain to a speech signal of a frequency domain using Fast Fourier Transform (FFT) and outputs the converted speech signal to the harmonic peak detector 30 and the search range determiner 40. The frequency domain converter 20 extracts and outputs a Short-Time Fourier Transform (STFT) absolute value of the speech signal of the frequency domain.

The harmonic peak detector 30 sets an actual peak search range of the speech signal using a peak search range input from the search range determiner 40, detects a plurality of peaks existing in the set peak search range and a spectral value corresponding to each peak, and determines a peak having the greatest spectral value among the detected peaks as a harmonic peak. Various conventional methods can be used as a method of detecting a plurality of peaks existing in the set peak search range. For example, when a value of a previous point of a certain point is less than a value of the certain point and a value of a subsequent point is also less than the value of the certain point, or when slopes before and after the certain point are changed from + to −, the certain point is a peak. The harmonic peak detector 30 can detect harmonic peaks from a beginning point of the speech signal to the end of a bandwidth of the speech signal by setting the peak search range from the beginning point of the speech signal when initially detecting a harmonic peak from the input speech signal and then continuously setting the peak search range based on the latest detected harmonic peak. The harmonic peak detector 30 outputs the peaks determined as harmonic peaks to the speech processing unit 70 and the spectral envelope detector 60 as harmonic information of the speech signal.

The search range determiner 40 calculates a CP value using the speech signal output from the frequency domain converter 20, determines a peak search range using the calculated CP value, and outputs the determined peak search range to the harmonic peak detector 30. The peak search range is an interval in which a harmonic peak of the speech signal is predicted to exist and includes a shifting interval and an actual search interval obtained by excluding the shifting interval from a total interval. The shifting interval is an interval in which peak detection is not performed by the harmonic peak detector 30 with respect to the speech signal, the actual search interval is an interval in which the peak detection is performed by the harmonic peak detector 30 with respect to the speech signal, and the total interval and the shifting interval can be dynamically set according to a state of the speech signal. Thus, a decrease of the number of actual search intervals can cause a decrease of the amount of computation of the harmonic peak detector 30.

Figure 3:
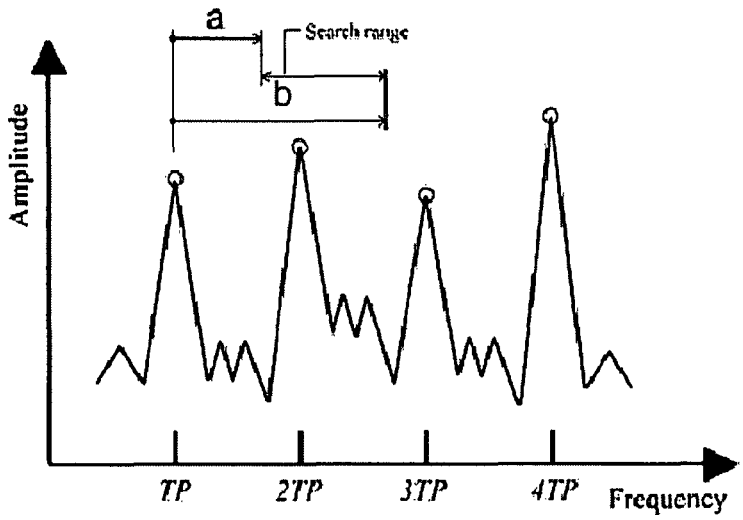
FIG. 3 illustrates a peak search range according to the present invention.

FIG. 3 shows a peak search range according to the present invention. In the peak search range, b denotes the total interval, a denotes the shifting interval, and b−a denotes the actual search interval.

FIG. 3 shows a graph of the frequency domain, wherein the horizontal axis indicates 'frequency', and the vertical axis indicates 'spectrum'. Thus, if it is assumed that a spectral value and a frequency of a peak selected as a first harmonic peak are $(W_1, A_1)$, subsequent harmonic peaks are represented by $(W_k, A_k)$ where k=2, 3, . . . , and each harmonic peak is detected as a peak having the greatest spectral value in each peak search range, i.e., between $W_{k-1}$+a and $W_{k-1}$+b. If a true harmonic peak cannot be detected in a peak search range, a subsequent peak search range may be re-set from the bin center of $W_{k-1}$+a CP value using the greatest end-point spectrum, and then a subsequent harmonic peak is detected.

Since the peak search range is an interval in which a harmonic peak is predicted to exist, the peak search range should be optimally determined, and thus, in the present invention, the peak search range is determined using the CP value. That is, a default value of the shifting interval a of the peak search range may be set to 0.5 CP, a default value of the total interval b may be set to 1.5 CP, and then the shifting interval a and the total interval b of the peak search range may be dynamically set using 'CP' according to a speech signal. When the peak search range is determined using a CP value, a confidence interval of a TP value is considered because the CP value may not match the TP value since the CP value is a predicted pitch value.

For example, in FIG. 3, if it is assumed that TP is 12.8 and the total interval b of the peak search range is 1.5 CP, when the shifting interval a and CP are changed, an effect of the shifting interval a, an effect of CP according to the selection of the shifting interval a, and a selection range of the meaningful shifting interval a are analyzed as described below.

When a harmonic peak is detected by predicting CP as 13 and setting the shifting interval a to $0 \leqq a \leqq 0.9$ CP, distortion hardly occurs in a spectral envelope detected by performing interpolation of the detected harmonic peaks. However, if the shifting interval a is set greater than CP, since a correct harmonic peak may not be detected, distortion significantly may occur in a spectral envelope obtained from the detected harmonic peaks. Likewise, when CP is predicted as 16, if the shifting interval a is set greater than 0.8 CP, since a correct harmonic peak may not included in the actual search interval, distortion significantly may occur in a spectral envelope obtained from the detected harmonic peaks.

Thus, only if the shifting interval a is less than TP (i.e., $a<TP$) after a first harmonic peak is selected, a subsequent harmonic peak-can be correctly selected. If the shifting interval a is $x \cdot CP$, the shifting coefficient x should be equal to or greater than 0 and less than TP/CP. In addition, if CP increases, the shifting coefficient x should decrease. That is, if CP is predicted as 13 or 16 when TP is 12.8, the shifting coefficient x should be less than 1 or 0.8.

In addition, while changing a CP value according to various shifting intervals a, a correlation between CP and distortion of a spectral envelope can be checked for each case. If the shifting interval a is 0, the sensitivity of CP decreases but the amount of computation increases. If the shifting interval a is equal to or greater than 0 and equal to or less than 0.7 CP, the amount of computation can be maintained below a predetermined level with preventing an increase of a degree of distortion. It is very important to maintain the actual search interval not to be more than double the length of TP.

Figure 4:
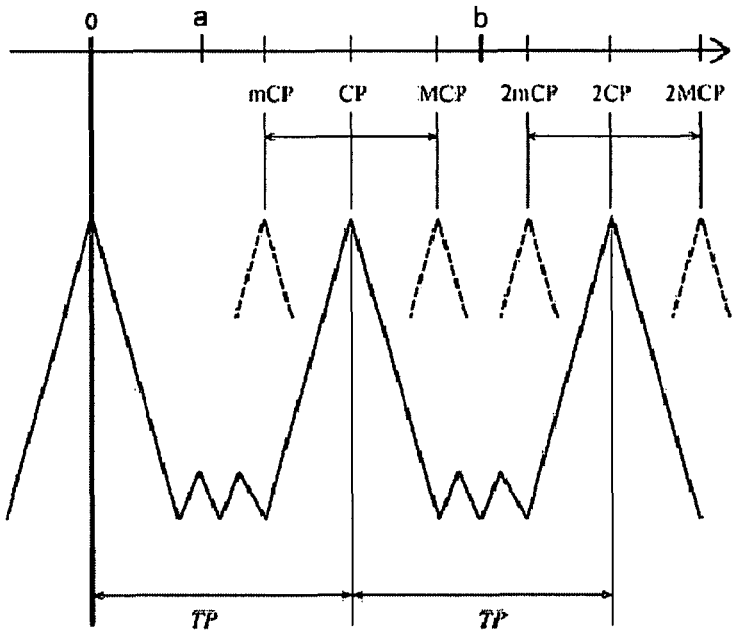
FIG. 4 illustrates how to set a peak search range according to the present invention.

According to the above analysis, a theoretical description for determining an optimal actual search interval can be performed. That is, a predetermined limitation of a CP range for the minimum error can be theoretically determined. To theoretically determine the predetermined limitation, a correlation between CP and TP should be considered. The concept of a confidence interval for the actual search interval according to the present invention is now introduced. The confidence interval is an interval that should be included in the actual search interval and will now be described with reference to FIGS. 3 and 4. FIG. 4 shows how to set a peak search range according to the present invention.

Referring to FIG. 4, the confidence interval can be represented by ($m \cdot CP$, $M \cdot CP$) in the frequency axis. It is assumed that TP is meaningfully determined (e.g., with 99.9% confidence). Ranges of m and M are represented by Equation (1).

$$0<m<1<M \tag{1}$$

The values of m and M are determined by the property of a CP estimator, and a correct CP estimator will allow the values of m and M to be very close to 1. In reality, when peaks are searched for, the peak search range satisfy the following two conditions. The first condition is that at least a harmonic peak exists in an actual search interval, and the second condition is that only one harmonic peak exists in the actual search interval.

If the first condition is not satisfied, an error occurrence rate increases significantly, and if the second condition is not satisfied, an error due to a wrong peak selection may occur. Thus, in order to satisfy the first condition, the total interval b of the peak search range should be set greater than TP, and the shifting interval a should be set less than TP. In addition, in order to satisfy the second condition, the total interval b should be set less than 2TP. These can be simultaneously represented by Equation (2).

$$TP<b<2TP \text{ and } 0<a<TP \tag{2}$$

As important analysis associated with the pitch detection process, several specific cases are considered. If pitch segmentation is available for a CP estimation value, CP is close to TP and TP/2, and thus, ranges of m, M, the shifting interval a, and the total interval b are determined using Equation (3).

$$\begin{aligned} &M>2, \\ &m<1 \text{ and } M \geqq 2m, \\ &b>2CP, \\ &a<CP \end{aligned} \tag{3}$$

These ranges satisfy the first condition but do not satisfy the second condition. Thus, a wrong peak may often be selected, resulting in the occurrence of very small spectral distortion in a segmented interval.

If the pitch doubling occurs, CP is close to TP and 2TP, and thus, ranges of m, M, the shifting interval a, and the total interval b are determined using Equation (4).

$$\begin{aligned} &M>2, \\ &M \geqq 2m, \\ &m<1/2, \\ &b>CP, \\ &a<CP/2 \end{aligned} \tag{4}$$

These ranges also satisfy the first condition but do not satisfy the second condition.

If both the pitch segmentation and the pitch doubling may occur, CP is close to 2TP, TP, or TP/2, and thus, ranges of m, M, the shifting interval a, and the total interval b are determined using Equation (5).

$$\begin{aligned} &M>2, \\ &M \geqq 2m, \\ &m<1/2, \\ &b>2CP, \\ &a<CP/2 \end{aligned} \tag{5}$$

These ranges also satisfy the first condition but do not satisfy the second condition.

Thus, in order to satisfy both the first condition and the second condition, optimal m, M, and the total interval b is determined using Equation (6).

$$\begin{aligned} &M=2m, \\ &b=M \cdot CP=2m \cdot CP \end{aligned} \tag{6}$$

The upper limit of the shifting interval a is determined by m. Unless CP is very correct without noise, a should be less than 0.7 CP. If pitch doubling is considered, for the safety, the shifting interval a should be selected as $a<0.5$ CP or $0.2\ CP \leqq a<0.4$ CP. The lower limit of the shifting interval a is determined considering the amount of computation.

If the pitch segmentation is not available, an optimal value of the total interval b is preferably set to $M \cdot CP$, i.e., $1.33\ CP \leqq b \leqq 1.5$ CP. If the pitch segmentation is available, the optimal value of the total interval b is preferably set to 2.3 CP≦b≦2.5 CP. These settings can be set by experiments.

Thus, ranges of m, M, the shifting interval a, and the total interval b, which satisfy both the first condition and the second condition, can be obtained as described below.

In order to satisfy the first condition, the total interval b is greater than M·CP, and the shifting interval a is less than m·CP. That is, the actual search interval should include the confidence interval for TP. In order to satisfy the second condition, the total interval b is less than 2m·CP, and thus, in order to satisfy both the first condition and the second condition, the total interval b is greater than M·CP and less than 2m·CP, and the shifting interval a is greater than 0 and less than m·CP, where M is less than 2m. This can be represented by Equation (7).

$$M\cdot CP<b<2m\cdot CP,$$

$$0<a<m\cdot CP,$$

$$\text{where } M<2m \text{ and } 0<m<1<M \tag{7}$$

Although the setting of the lower limit of the shifting interval a does not affect the amount of computation, around 0.7 m·CP optimizes the amount of computation. Where CP calculation of the search range determiner 40 is very correct or where there is no noise, 0.7 m·CP is preferably used as a default value of the lower limit of the shifting interval a.

If m (<1) and M (>1) are close to 1 and the pitch segmentation and the pitch doubling hardly occur since CP calculation of the search range determiner 40 is very correct, the actual search interval can be significantly reduced. That is, the total interval b is determined as an approximate value of M·CP, and the shifting interval a is determined as an approximate value of m·CP. That is, if the peak search range is set using the lowermost limit of the total interval b and the uppermost limit of the shifting interval a, the total amount of computation is significantly reduced. However, if there is noise, the actual search interval should set to a greater value.

The search range determiner 40 determines the peak search range according to an input speech signal by considering the above-described situations. When the harmonic peak detector 30 detects an initial harmonic peak from the input speech signal, the search range determiner 40 determines the peak search range by setting the total interval b to CP and the shifting interval a to 0 so the actual search interval is CP, and outputs the determined peak search range to the harmonic peak detector 30. In other cases, the search range determiner 40 determines the peak search range so the shifting interval a and the actual search interval are determined considering the above-described situations, and outputs the determined peak search range to the harmonic peak detector 30.

The high-order peak determiner 50 determines whether a harmonic peak output from the harmonic peak detector 30 is a high-order peak of more than $2^{nd}$ order and outputs the determination result to the harmonic peak detector 30 and the speech processing unit 70. Since a harmonic peak is a high-order peak of more than $2^{nd}$ order and an error may occur when the peak search range is set, it is necessary to determine whether a peak selected as a harmonic peak by the harmonic peak detector 30 is a high-order peak of more than $2^{nd}$ order, and thus the high-order peak determiner 50 is included in the apparatus shown in FIG. 1. However, according to the present invention, since a peak selected as a harmonic peak by the harmonic peak detector 30 is a peak having the greatest spectral value among all peaks existing within the peak search range, the peak is basically a high-order peak of more than $2^{nd}$ order. Thus, the high-order peak determiner 50 can be selectively included in the apparatus shown in FIG. 1.

Figure 5:
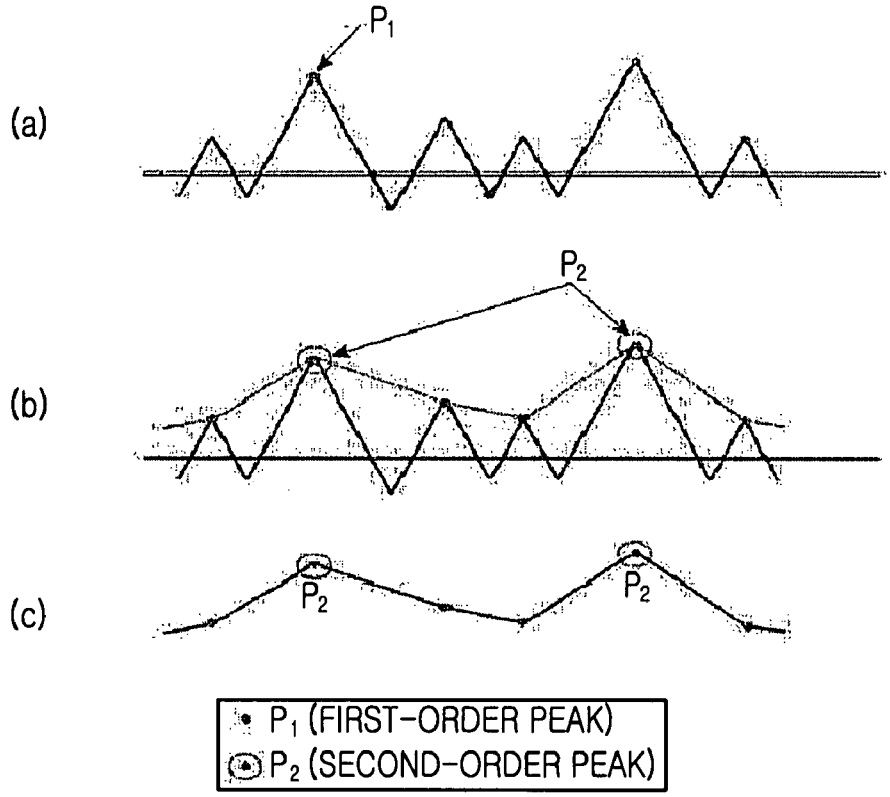
FIG. 5 illustrates high-order peaks according to the present invention.

When peaks in a general concept are first-order peaks, in the present invention, high-order peaks means new peaks in a signal formed with the first-order peaks. That is, peaks of the first-order peaks are defined as second-order peaks, and likewise, third-order peaks are peaks in a signal formed with the second-order peaks. The high-order peaks are defined as described above. Thus, second-order peaks can be detected by reconfiguring first-order peaks in new time series and extracting peaks of the time series. FIG. 5 shows high-order peaks according to the present invention. Diagram (a) of FIG. 5 shows first-order peaks P1. Peaks initially detected in an actual search interval by the harmonic peak detector 30 are the first-order peaks P1 shown in diagram (a) of FIG. 5. Peaks obtained when the first-order peaks P1 are connected, as shown in diagram (b) of FIG. 5, are defined as second-order peaks P2 as shown in diagram (c) of FIG. 5. In the present invention, the peaks selected as harmonic peaks by the harmonic peak detector 30 are at least second-order peaks. Although how to obtain second-order peaks is shown in FIG. 5, peaks of the second-order peaks P2 can be defined as third-order peaks, and in the same manner, up to $N^{th}$-order peaks can be defined, where N denotes a natural number.

These high-order peaks provide very effective statistical values in feature extraction of a speech or audio signal. According to a characteristic of high-order peaks suggested in the present invention, higher-order peaks have a higher level and appears less frequently than lower-order peaks. For example, the number of second-order peaks is less than the number of first-order peaks. An appearance rate of each-order peaks can be very usefully used in the feature extraction of a speech or audio signal, and in particular, second-order and third-order peaks have pitch extraction information. In addition, the time between the second-order peaks and the third-order peaks and the number of sampling points have much information regarding the feature extraction of a speech or audio signal.

Rules of the high-order peaks are as follows.

1. Only one valley (peak) can exist between consecutive peaks (valleys).
2. The rule 1 is applied to each-order peaks (valleys).
3. High-order peaks (valleys) exist less than lower-order peaks (valleys) and exist in a subset of the lower-order peaks (valleys).
4. At least one lower-order peak (valley) always exists between any two consecutive high-order peaks (valleys).
5. High-order peaks (valleys) have a higher (lower) level in average than lower order peaks (valleys).
6. An order in which only one peak and one valley (e.g., the maximum value and the minimum value in one frame) exist for a specific duration (e.g., during one frame) of a signal.

The high-order peaks or valleys can be used as very effective statistical values in the feature extraction of a speech or audio signal, and in particular, second-order and third-order peaks among each-order peaks have pitch information of the speech or audio signal. In addition, the time between the second-order peaks and the third-order peaks and the number of sampling points have much information regarding the feature extraction of a speech or audio signal.

Referring back to FIG. 1, according to the present invention, the harmonic peak detector 30 selects a peak having the greatest spectral value among peaks detected in the actual search interval of the peak search range, i.e., a high-order peak of more than $2^{nd}$ order, as a harmonic peak and outputs the harmonic peak to the spectral envelope detector 60 and the speech processing unit 70.

Figure 6:
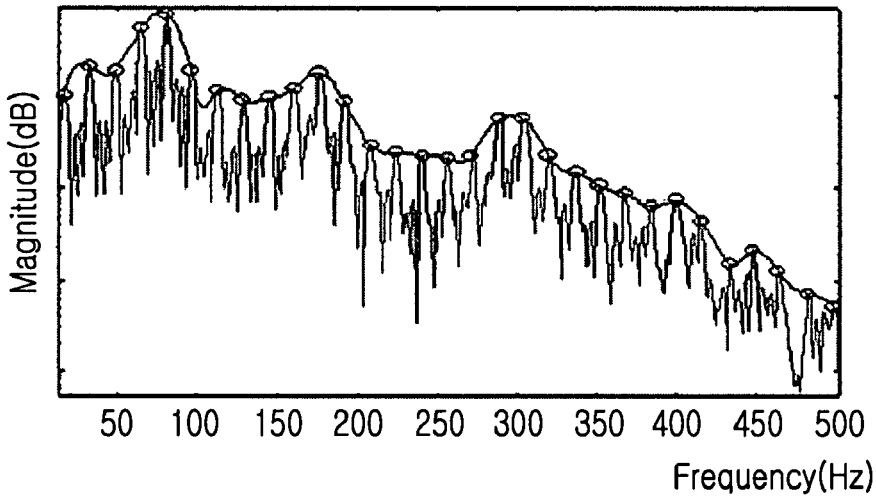
FIG. 6 illustrates spectral envelope information generated by performing interpolation of harmonic peaks detected according to the present invention.

The spectral envelope detector 60 generates a spectral envelope shown in FIG. 6 by performing interpolation of the harmonic peaks input from the harmonic peak detector 30 according to the present invention, extracts spectral envelope information from the generated spectral envelope, and outputs the extracted spectral envelope information to the speech processing unit 70. FIG. 6 shows spectral envelope information generated by performing interpolation of harmonic peaks detected according to the present invention.

Thus, the high-order peak determiner 50 controls the harmonic peak detector 30 so first-order peaks are not included in the peaks selected as harmonic peaks by the harmonic peak detector 30. That is, the high-order peak determiner 50 prevents distortion of spectral envelope information that is to be detected by the spectral envelope detector 60 by detecting true harmonic peaks and canceling wrong small noise peaks by selecting only high-order peaks of more than $2^{nd}$ order from among the peaks detected by the harmonic peak detector 30 before the spectral envelope detector 60 performs interpolation.

The speech processing unit 70 performs audio processing, such as speech coding, recognition, synthesis, and enhancement, using the harmonic peaks, the harmonic information, and the spectral envelope information input from the harmonic peak detector 30 and the spectral envelope detector 60.

Figure 2:
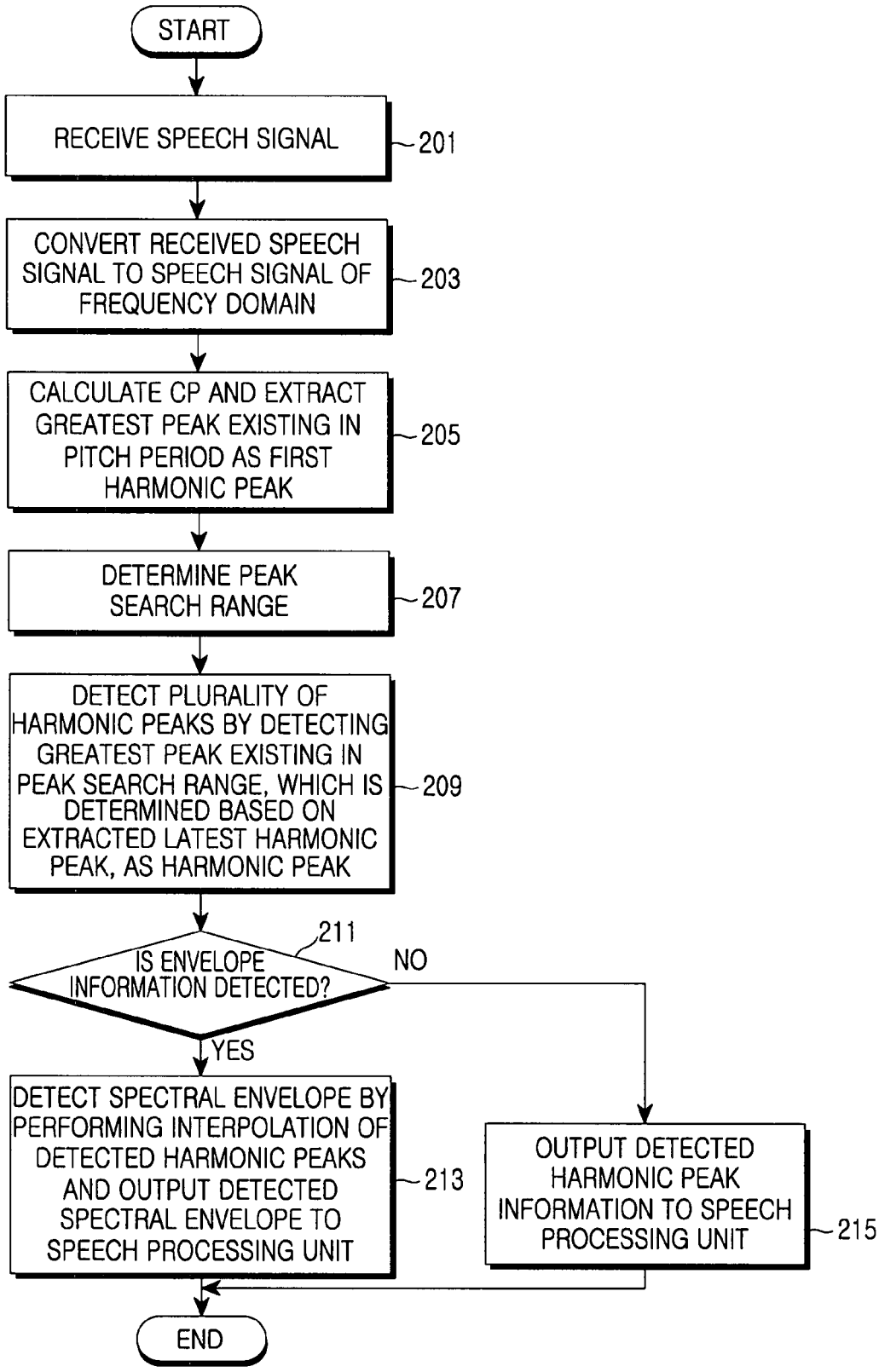
FIG. 2 is a flowchart illustrating a method of estimating harmonic information and spectral envelope information of a speech signal according to the present invention.

The apparatus shown in FIG. 1 estimates harmonic peaks and spectral envelope information of a speech signal according to the process shown in FIG. 2. FIG. 2 shows a method of estimating harmonic information and spectral envelope information of a speech signal according to the present invention. When the speech signal input unit 10 receives a speech signal in step 201, the speech signal input unit 10 outputs the received speech signal to the frequency domain converter 20. The frequency domain converter 20 converts the received speech signal of the time domain to a speech signal of the frequency domain in step 203 and outputs the converted speech signal to the harmonic peak detector 30 and the search range determiner 40. In step 205, the search range determiner 40 calculates a CP value using the input speech signal, determines a peak search range so that an actual search interval is set to CP, and outputs the determined peak search range to the harmonic peak detector 30. The harmonic peak detector 30 detects all peaks existing in the interval corresponding to CP from the beginning of the speech signal according to the input peak search range and extracts a peak having the greatest spectral value among the detected peaks as a first harmonic peak. In step 207, the search range determiner 40 determines a peak search range including a proper total interval and shifting interval using the calculated CP value and outputs the determined peak search range to the harmonic peak detector 30.

In step 209, the harmonic peak detector 30 sets a peak search range based on a lately extracted harmonic peak and detects all peaks existing in the set peak search range. The harmonic peak detector 30 outputs harmonic information existing in the speech signal by determining a peak having the greatest spectral value among the detected peaks as a harmonic peak. The high-order peak determiner 50 controls the harmonic peak detector 30 to detect high-order peaks of more than $2^{nd}$ order as harmonic peaks. That is, the high-order peak determiner 50 determines whether a peak detected as a harmonic peak by the harmonic peak detector 30 is a high-order peak of more than $2^{nd}$ order, and if it is determined that the detected peak is a high-order peak of more than $2^{nd}$ order, the high-order peak determiner 50 controls the harmonic peak detector 30 to output the detected peak as a harmonic peak. It is determined in step 211 whether envelope information is detected. If it is determined in step 211 that envelope information is detected, the harmonic peak detector 30 outputs the peaks determined as harmonic peaks to the spectral envelope detector 60. If it is determined in step 211 that envelope information is not detected, i.e., when harmonic peak information is used, the harmonic peak detector 30 outputs the peaks determined as harmonic peaks to the speech processing unit 70 in step 215. In step 213, the spectral envelope detector 60 detects a spectral envelope by performing interpolation of the detected harmonic peaks and outputs spectral envelope information to the speech processing unit 70. The speech processing unit 70 performs audio processing, such as speech coding, recognition, synthesis, and enhancement, using the harmonic peaks and the spectral envelope information input from the harmonic peak detector 30 and the spectral envelope detector 60.

As described above, the apparatus for estimating harmonic information and spectral envelope information of a speech signal according to the present invention can detect harmonic peaks with a small amount of computation by setting a peak search range having the possibility of existence of a harmonic peak in the speech signal, detecting peaks existing in the set peak search range, and detecting a peak having the greatest value among the detected peaks as a harmonic peak, and detect spectral envelope information with a simple process by performing interpolation of the detected harmonic peaks.

According to the present invention, another apparatus for estimating harmonic information and spectral envelope information of a speech signal may be configured to detect harmonic peaks and non-harmonic peaks excluding the harmonic peaks according to the above-described process, detect spectral envelope information of each of the harmonic peaks and the non-harmonic peaks, compares the spectral envelope information of the harmonic peaks and the spectral envelope information of the non-harmonic peaks, and detect a degree of voicing. In other words, the other apparatus for estimating harmonic information and spectral envelope information of a speech signal according to the present invention may perform audio processing by detecting, harmonic peaks, harmonic spectral envelope information, non-harmonic spectral envelope information, and a degree of voicing.

Figure 7:
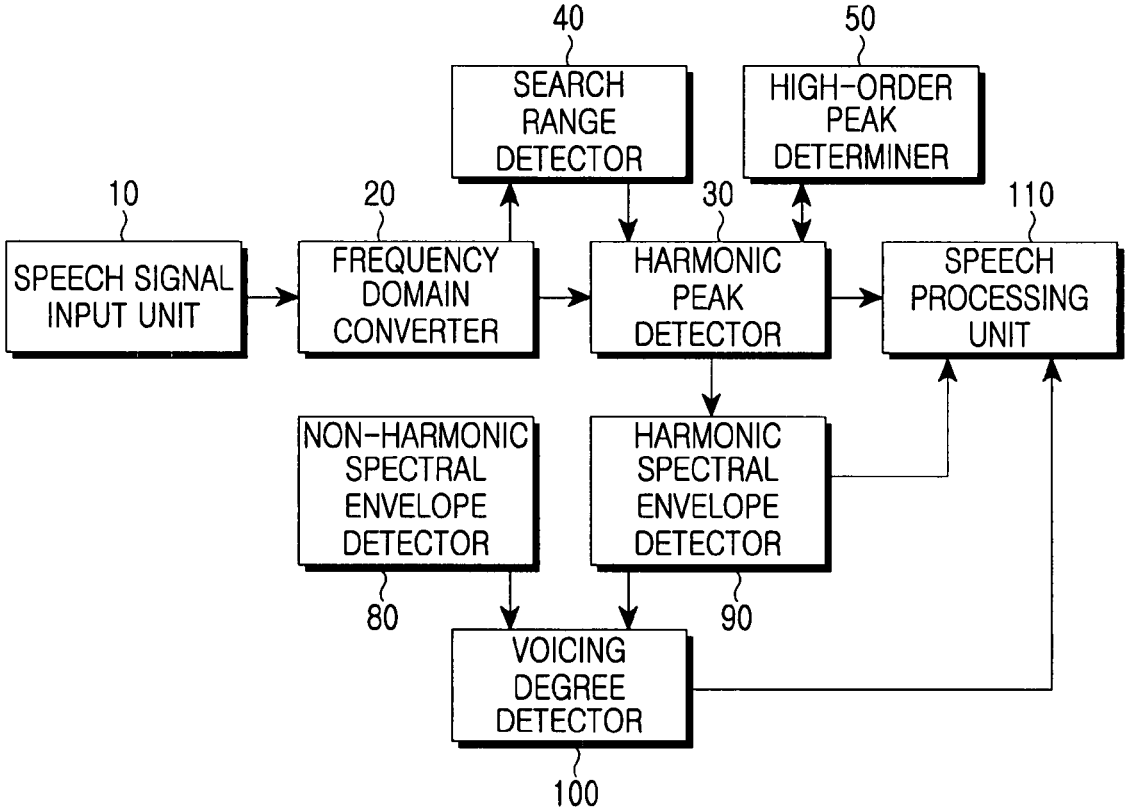
FIG. 7 is a block diagram of an apparatus for estimating harmonic information and spectral envelope information of a speech signal according to the present invention.

FIG. 7 shows another apparatus for estimating harmonic information and spectral envelope information of a speech signal according to the present invention. The apparatus includes a speech signal input unit 10, a frequency domain converter 20, a harmonic peak detector 120, a search range determiner 40, a high-order peak determiner 50, a non-harmonic spectral envelope detector 80, a harmonic spectral envelope detector 90, a voicing degree detector 100, and a speech processing unit 110.

The configurations and operational processes of the speech signal input unit 10, the frequency domain converter 20, the search range determiner 40, and the high-order peak determiner 50 shown in FIG. 7 are similar to those of the corresponding components shown in FIG. 1.

The harmonic peak detector 120 detects all peaks existing in an actual search interval of a peak search range set by the search range determiner 40. The harmonic peak detector 120 outputs harmonic information of the speech signal to the harmonic spectral envelope detector 90 and the speech processing unit 110 by determining a peak having the greatest spectral value among the detected peaks as a harmonic peak, and outputs non-harmonic information of the speech signal to the non-harmonic spectral envelope detector 80 by determining peaks excluding the peak determined as a harmonic peak among the detected peaks as non-harmonic peaks.

The non-harmonic spectral envelope detector 80 detects a non-harmonic spectral envelope by performing interpolation of the input non-harmonic peaks and outputs the detected non-harmonic spectral envelope information to the voicing degree detector 100.

The harmonic spectral envelope detector 90 detects a harmonic spectral envelope by performing interpolation of the input harmonic peaks and outputs the detected harmonic spectral envelope information to the voicing degree detector 100 and the speech processing unit 110.

The voicing degree detector 100 detects a degree of voicing by comparing energy of the input harmonic spectral envelope to energy of the input non-harmonic spectral envelope. The degree of voicing is a degree indicating how close to a voiced sound the speech signal is, and if the speech signal has a high degree of voicing, the speech signal is close to a voiced sound.

While peaks of an unvoiced sound or noise has generally almost the same spectral values, spectral values of harmonic peaks of a voiced sound are significantly different from spectral values of non-harmonic peaks of the voiced sound, the spectral values of the harmonic peaks being greater than the spectral values of the non-harmonic peaks. This means that if spectral values of harmonic peaks constituting an arbitrary speech signal are greater than spectral values of non-harmonic peaks, the speech signal has a high possibility of a voiced sound. The voicing degree detector 100 detects a degree of voicing using the property of a voiced sound and an unvoiced sound. That is, the voicing degree detector 100 detects a degree of voicing of a speech signal by comparing energy of a spectral envelope generated by performing interpolation of peaks selected as harmonic peaks among peaks of the speech signal to energy of a spectral envelope generated by performing interpolation of peaks, i.e., non-harmonic peaks, excluding the peaks selected as harmonic peaks among the peaks of the speech signal, outputting a high degree of voicing if a difference between the two energy values is high, and outputting a low degree of voicing if a difference between the two energy values is low. If it is assumed that $W_n$ indicates a non-harmonic spectral envelope and $S_n$ indicates a harmonic spectral envelope, a degree of voicing D is calculated by Equation (8).

$$D = \frac{1}{M}\sum_{n=1}^{M}\left(1 - \frac{W_n^2}{S_n^2}\right) \tag{8}$$

The degree of voicing D (>1) calculated by Equation (8) is compared to a threshold for distinguishing a voiced sound from an unvoiced sound (which is adaptively determined according to an environment), and if D is greater than the threshold, a speech signal is determined as a voiced sound, and if D is less than the threshold, the speech signal is determined as an unvoiced sound or noise. The threshold can be adaptively determined according to a used specific system and an environment.

Figure 9:
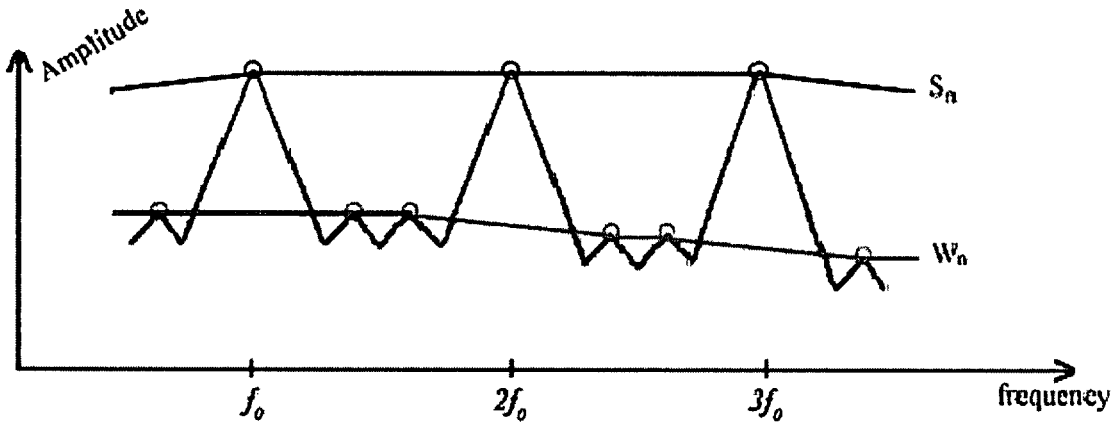
FIG. 9 illustrates energy of a non-harmonic peak spectral envelope and energy of a harmonic peak spectral envelope extracted according to the present invention.

The distinguishing of a voiced sound from an unvoiced sound by setting the threshold is not a necessary operation, and the use of the threshold is determined according to requirements of a system. In a general application, without using the threshold, it is determined that an input speech signal is close to an unvoiced sound or noise if D is small (close to 1), and it is determined that an input speech signal is close to a voiced sound if D is large. In the present invention, another method of efficiently providing how to extract information on a degree of voicing is suggested. FIG. 9 shows energy of a non-harmonic peak spectral envelope and energy of a harmonic peak spectral envelope, which are extracted according to the present invention. A spectral envelope $S_n$ indicates a harmonic spectral envelope generated by the harmonic spectral envelope detector 90 performing interpolation of the harmonic peaks detected by the harmonic peak detector 120 according to the present invention. A spectral envelope $W_n$ indicates a non-harmonic spectral envelope generated by the non-harmonic spectral envelope detector 80 performing interpolation of the non-harmonic peaks detected by the harmonic peak detector 120 according to the present invention. As shown in FIG. 9, a difference exists between energy values of the two envelopes, and the voicing degree detector 100 detects a degree of voicing according to the energy difference and outputs the detected degree of voicing to the speech processing unit 110.

The speech processing unit 110 performs audio processing, such as speech coding, recognition, synthesis, and enhancement, using the harmonic peaks, the harmonic spectral envelope information, and the degree of voicing input from the harmonic peak detector 120, the harmonic spectral envelope detector 90, and the voicing degree detector 100.

Figure 8:
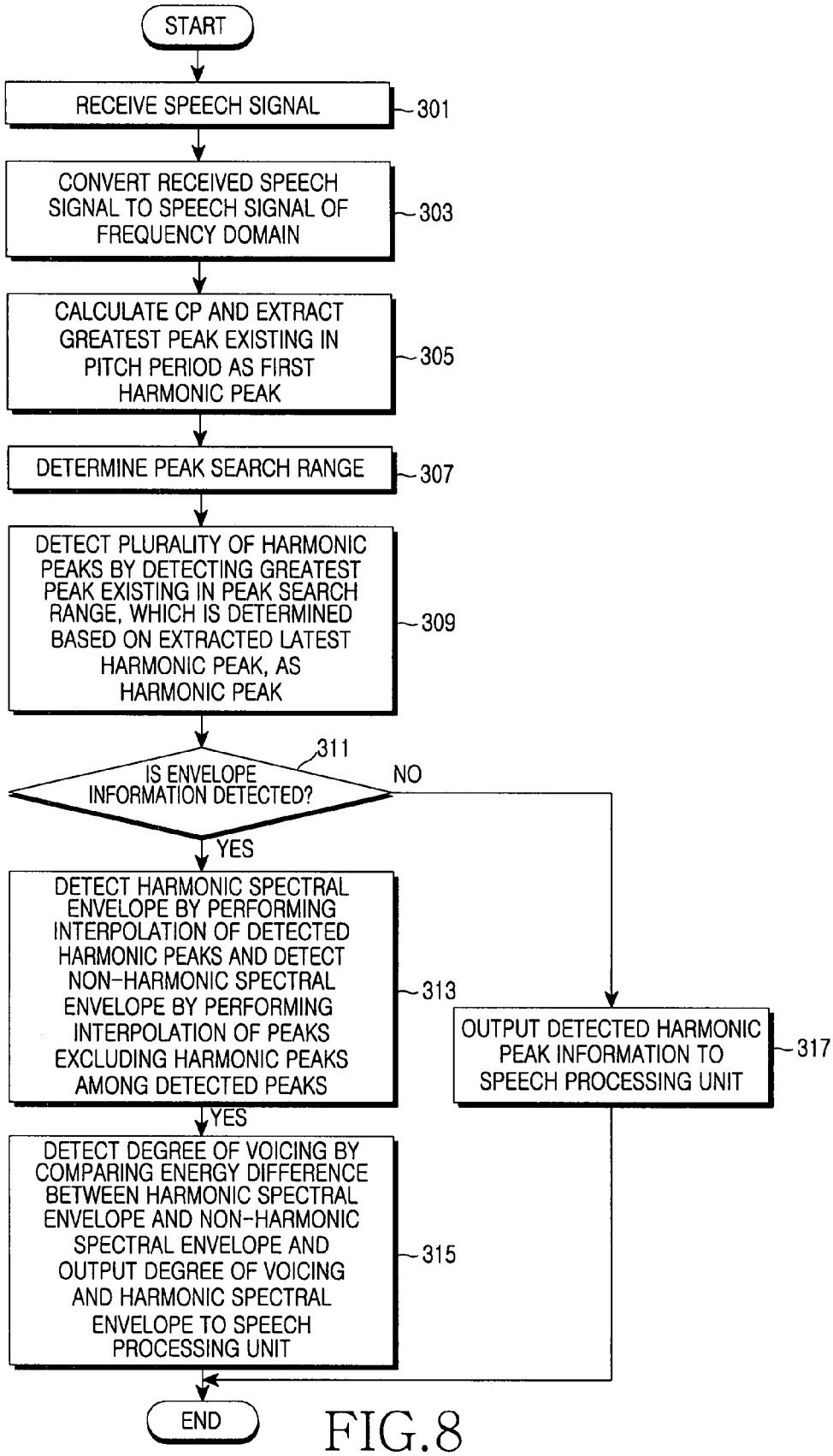
FIG. 8 is a flowchart illustrating a method of estimating harmonic information and spectral envelope information of a speech signal according to the present invention.

The apparatus shown in FIG. 7 estimates harmonic peaks and spectral envelope information of a speech signal according to the process shown in FIG. 8. FIG. 8 shows a method of estimating harmonic information and spectral envelope information of a speech signal according to the present invention. When the speech signal input unit 10 receives a speech signal in step 301, the speech signal input unit 10 outputs the received speech signal to the frequency domain converter 20. The frequency domain converter 20 converts the received speech signal of the time domain to a speech signal of the frequency domain in step 303 and outputs the converted speech signal to the harmonic peak detector 120 and the search range determiner 40. In step 305, the search range determiner 40 calculates a CP value using the input speech signal, determines a peak search range so that an actual search interval is set to CP, and outputs the determined peak search range to the harmonic peak detector 120. The harmonic peak detector 120 detects all peaks existing in the interval corresponding to CP from the beginning of the speech signal according to the input peak search range and extracts a peak having the greatest spectral value among the detected peaks as a first harmonic peak. In step 307, the search range determiner 40 determines a peak search range including a proper total interval and shifting interval using the calculated CP value and outputs the determined peak search range to the harmonic peak detector 120.

In step 309, the harmonic peak detector 120 sets a peak search range based on a lately extracted harmonic peak and detects all peaks existing in the set peak search range. The harmonic peak detector 120 outputs a plurality of harmonic peaks existing in the speech signal by determining a peak having the greatest spectral value among the detected peaks as a harmonic peak. The high-order peak determiner 50 controls the harmonic peak detector 120 to detect high-order peaks of more than $2^{nd}$ order as harmonic peaks. That is, the high-order peak determiner 50 determines whether a peak detected as a harmonic peak by the harmonic peak detector 120 is a high-order peak of more than $2^{nd}$ order, and if it is determined that the detected peak is a high-order peak of more than $2^{nd}$ order, the high-order peak determiner 50 controls the harmonic peak detector 30 to output the detected peak as a harmonic peak. It is determined in step 311 whether envelope information is detected. If it is determined in step 311 that envelope information is not detected, i.e., when harmonic peak information is used, the harmonic peak detector 120 outputs the peaks determined as harmonic peaks to the speech processing unit 110 in step 317. If it is determined in step 311 that envelope information is detected, the harmonic peak detector 120 outputs the peaks determined as harmonic peaks to the harmonic spectral envelope detector 90 and outputs peaks remaining by excluding the peaks determined as harmonic peaks to the non-harmonic spectral envelope detector 80.

In step 313, the harmonic spectral envelope detector 90 generates a harmonic spectral envelope by performing interpolation of the input harmonic peaks and outputs the harmonic spectral envelope to the speech processing unit 110, and the non-harmonic spectral envelope detector 80 generates a non-harmonic spectral envelope by performing interpolation of the input peaks and outputs the non-harmonic spectral envelope to the voicing degree detector 100. In step 315, the voicing degree detector 100 detects a degree of voicing by performing an energy comparison between the harmonic spectral envelope and the non-harmonic spectral envelope and outputs the detected degree of voicing to the speech processing unit 110, and the harmonic spectral envelope detector 90 outputs the harmonic spectral envelope to the speech processing unit 110. The speech processing unit 110 performs audio processing, such as speech coding, recognition, synthesis, and enhancement, using the harmonic peaks, the spectral envelope information, and the degree of voicing input from the harmonic peak detector 120, the harmonic spectral envelope detector 90, and the voicing degree detector 100.

As described above, according to the present invention, a degree of voicing is extracted using the characteristic of harmonic peaks existing in a constant period by converting an input speech or audio signal to a speech signal of the frequency domain, selecting the greatest peak in a first pitch period of the converted speech signal as a harmonic peak, thereafter selecting a peak having the greatest spectral value among peaks existing in each peak search range of the speech signal as a harmonic peak, extracting harmonic spectral envelope information by performing interpolation of the selected harmonic peaks, extracting non-harmonic spectral envelope information by performing interpolation of the non-harmonic peaks, and comparing the two pieces of envelope information to each other.

Thus, by extracting and using only harmonic peaks always having a spectral value greater than noise, the present invention has high noise resistance. Since only peak information is simply detected by comparing previous and subsequent values based on a certain point of a speech signal, the amount of computation is very small, and the detection of the peak information is very quick, correct, and practical. In addition, by selecting only harmonic peaks before interpolation is performed using a new high-order peak concept, the performance can be improved by preventing the possibility of spectral distortion which may occur by determining a too small peak search range due to a pitch information error. In addition, by extracting a very efficient degree of voicing through the intellectual computation of an energy ratio using a ratio of a spectrum of harmonic peaks to a spectrum of non-harmonic peaks, the degree of voicing can be used for coding, recognition, synthesis, and enhancement. In particular, the extraction of harmonic information with a small amount of computation and correct harmonic section detection results in the efficiency for applications, such as cellular phones, telematics, Personal Digital Assistants (PDAs), and MP3 players, requiring high mobility, the limitation of computation or storage capacity, or quick processing.

While the invention has been shown and described with reference to certain preferred embodiments thereof, it will be understood by those skilled in the art that various changes in form and details may be made therein without departing from the spirit and scope of the invention. For example, the voicing degree detector 100 according to the present invention is configured to detect a degree of voicing by comparing energy of a detected harmonic spectral envelope to energy of a detected non-harmonic spectral envelope. However, even without the harmonic spectral envelope and the non-harmonic spectral envelope, which are detected according to the present invention, the voicing degree detector 100 can be configured to detect a degree of voicing only if a harmonic spectral envelope and a non-harmonic spectral envelope can be detected. Thus, the spirit and scope of the invention will be defined by the appended claims.

What is claimed is:

1. A method of estimating harmonic information and spectral envelope information of a speech signal, the method comprising the steps of:

converting a received speech signal of a time domain to a speech signal of a frequency domain;

calculating a coarse pitch value of the speech signal and determining a peak search range using the coarse pitch value;

setting a plurality of peak search ranges in the speech signal, detecting peaks existing in each of the peak search ranges, determining a peak having the greatest spectral value among the detected peaks as a harmonic peak in each of the peak search ranges, and outputting the harmonic peak of each of the peak search ranges as harmonic information of the speech signal; and generating a harmonic spectral envelope by performing interpolation of the harmonic peaks, and outputting the generated harmonic spectral envelope as spectral envelope information of the speech signal, wherein the determined peak search range comprises a total interval, a shifting interval in which peak detection is not performed, and an actual search interval in which the peak detection is performed, the actual search interval is an interval excluding the shifting interval from the total interval, the total interval is determined to be greater than the coarse pitch value, and the shifting interval is determined to be less than the coarse pitch value, wherein when CP denotes the coarse pitch value, b denotes the total interval, and a denotes the shifting interval, the peak search range is determined by the equation below $$M \cdot CP < b < 2m \cdot CP,$$

$$0 < a < m \cdot CP,$$

where $M<2m$ and $0<m<1<M$.

2. The method of claim 1, wherein when an initial harmonic peak of the speech signal is detected, the total interval is set to the coarse pitch value, and the shifting interval is set to 0.

3. The method of claim 2, wherein in the step of determining and outputting a harmonic peak, the peak search range is set based on the latest harmonic peak detected from the speech signal.

4. The method of claim 3, wherein the step of determining and outputting a harmonic peak comprises determining and outputting a peak as a harmonic peak when it is determined that the peak having the greatest spectral value is a high-order peak of more than $2^{nd}$ order.

5. The method of claim 4, further comprising:

generating and outputting a non-harmonic spectral envelope by performing interpolation of peaks excluding the harmonic peak from among the peaks detected in each of the peak search ranges; and detecting a degree of voicing indicating a rate of a voiced sound included in the speech signal by comparing energy of the harmonic spectral envelope to energy of the non-harmonic spectral envelope.

6. The method of claim 5, further comprising performing audio coding, recognition, and synthesis using the harmonic information, the harmonic spectral envelope information, and the degree of voicing.

7. A method of estimating a degree of voicing of a speech signal using spectral envelope information of the speech signal, the method comprising the steps of:

detecting harmonic spectral envelope information comprising harmonic peaks of the speech signal;

detecting non-harmonic spectral envelope information comprising peaks excluding the harmonic peaks among peaks of the speech signal; and detecting a degree of voicing indicating a rate of a voiced sound included in the speech signal by comparing energy of the harmonic spectral envelope to energy of the non-harmonic spectral envelope.

8. The method of claim 7, wherein the step of detecting harmonic spectral envelope information comprises:

converting a received speech signal of a time domain to a speech signal of a frequency domain;

calculating a coarse pitch value of the speech signal and determining a peak search range using the coarse pitch value;

setting a plurality of peak search ranges in the speech signal, detecting peaks existing in each of the peak search ranges, determining a peak having the greatest spectral value among the detected peaks as a harmonic peak in each of the peak search ranges, and outputting the determined harmonic peak for each of the peak search ranges; and generating a harmonic spectral envelope by performing interpolation of the harmonic peaks, and outputting the generated harmonic spectral envelope as spectral envelope information of the speech signal, wherein the step of detecting non-harmonic spectral envelope information comprises generating and outputting a non-harmonic spectral envelope by performing interpolation of peaks excluding the peak determined as a harmonic peak among the peaks detected in each of the peak search ranges.

9. An apparatus for estimating harmonic information and spectral envelope information of a speech signal, the apparatus comprising;

a frequency domain converter for converting a received speech signal of a time domain to a speech signal of a frequency domain;

a search range determiner for calculating a coarse pitch value of the speech signal output from the frequency domain converter and determining a peak search range using the coarse pitch value;

a harmonic peak detector for setting a plurality of peak search ranges in the speech signal, detecting peaks existing in each of the peak search ranges, determining a peak having the greatest spectral value among the detected peaks as a harmonic peak in each of the peak search ranges, and outputting the harmonic peak of each of the peak search ranges as harmonic information of the speech signal; and a harmonic spectral envelope detector for generating a harmonic spectral envelope by performing interpolation of the harmonic peaks, and outputting the generated harmonic spectral envelope as spectral envelope information of the speech signal, wherein the peak search range comprises a total interval, a shifting interval in which peak detection is not performed, and an actual search interval in which the peak detection is performed, the actual search interval is an interval excluding the shifting interval from the total interval, wherein the total interval is determined to be greater than the coarse pitch value, and the shifting interval is determined to be less than the coarse pitch value, wherein when CP denotes the coarse pitch value, b denotes the total interval, and a denotes the shifting interval, the peak search range is determined by $$M \cdot CP < b < 2m \cdot CP,$$

$$0 < a < m \cdot CP,$$

where $M<2m$ and $0<m<1<M$.

10. The apparatus of claim 9, wherein when an initial harmonic peak of the speech signal is detected, the search range determiner sets the total interval to the coarse pitch value and the shifting interval to 0.

11. The apparatus of claim 10, wherein the harmonic peak detector sets the peak search range based on the latest harmonic peak detected from the speech signal.

12. The apparatus of claim 11, wherein the harmonic peak detector determines and outputs the peak as a harmonic peak when it is determined that the peak having the greatest spectral value is a high-order peak of more than $2^{nd}$ order.

13. The apparatus of claim 11, further comprising:

a non-harmonic spectral envelope detector for generating and outputting a non-harmonic spectral envelope by performing interpolation of peaks excluding the harmonic peak from among the peaks detected in each of the peak search ranges; and a voicing degree detector for detecting a degree of voicing indicating a rate of a voiced sound included in the speech signal by comparing energy of the harmonic spectral envelope to energy of the non-harmonic spectral envelope.

14. The apparatus of claim 13, further comprising a speech processing unit for performing audio coding, recognition, and synthesis using the harmonic information, the harmonic spectral envelope information, and the degree of voicing.

15. The apparatus of claim 14, wherein when D denotes the degree of voicing, $S_n$ denotes the harmonic spectral envelope, and $W_n$ denotes the non-harmonic spectral envelope, the degree of voicing D is detected by $$D = \frac{1}{M}\sum_{n=1}^{M}\left(1 - \frac{W_n^2}{S_n^2}\right).$$

* * * * *